US008392277B2

(12) United States Patent
Taylor

(10) Patent No.: US 8,392,277 B2
(45) Date of Patent: Mar. 5, 2013

(54) SYSTEMS AND METHODS FOR ALLOCATING UNITS TO USERS IN AN ONLINE ENVIRONMENT

(75) Inventor: Dean Taylor, Lilyfield (AU)

(73) Assignee: Cracka IP Pty Ltd, Pyrmont (AU)

( * ) Notice: Subject to any disclaimer, the term of this patent is extended or adjusted under 35 U.S.C. 154(b) by 0 days.

(21) Appl. No.: 13/078,253

(22) Filed: Apr. 1, 2011

(65) Prior Publication Data

US 2011/0246320 A1 Oct. 6, 2011

(30) Foreign Application Priority Data

Apr. 6, 2010 (AU) ..... 2010901450

(51) Int. Cl.
*G06Q 30/00* (2012.01)

(52) U.S. Cl. ..... 705/26.3; 705/26.1

(58) Field of Classification Search ..... 705/26.1, 705/26.3, 27.1
See application file for complete search history.

(56) References Cited

U.S. PATENT DOCUMENTS 5,890,138 A * 3/1999 Godin et al. ..... 705/26.3
7,251,630 B1 7/2007 Gupta et al. ..... 705/37
7,409,368 B2 8/2008 Hogendoorn ..... 705/37
2005/0091144 A1 * 4/2005 Longman et al. ..... 705/37
2005/0187859 A1 * 8/2005 Growney et al. ..... 705/37
2009/0006221 A1 * 1/2009 Asher et al. ..... 705/27
2009/0076926 A1 * 3/2009 Zinberg et al. ..... 705/26

OTHER PUBLICATIONS

Anonymous, "Individual Investor Group Acquires Stake in ReverseAuction.com for $2.1 Million in Advertising," PR Newswire, Feb. 24, 2000, p. 1.*

Australian Examiner's Report for corresponding AU Patent No. 2011100530, dated Jul. 27, 2011, 3 pages.

* cited by examiner

*Primary Examiner* — Brandy A Zukanovich
(74) *Attorney, Agent, or Firm* — Seed IP Law Group PLLC

(57) ABSTRACT

Described herein are systems and methods for allocating units to users, for example in the context of an online auction environment. In overview, the technology described herein provides for an auction process whereby a decrementing price is combined with a competitive hidden-bid process. Users participate in the auction for the purpose of obtaining a desired number of units from a stockpile of like units, such as bottles of a particular batch of wine. The users effectively have two modes of participation. The first is to purchase units at a system-defined price, which decrements at predetermined intervals. The second is to place a bid at a user-defined price, this bid being deemed as successful when the system-defined price decrements to a value of equal to or less than the user-defined price.

11 Claims, 3 Drawing Sheets

SYSTEMS AND METHODS FOR ALLOCATING UNITS TO USERS IN AN ONLINE ENVIRONMENT

FIELD OF THE INVENTION

The present invention relates to systems and methods for allocating units to users in an online environment, and more particularly to computer implemented technologies for delivering auction functionalities via the Internet. Embodiments of the invention have been particularly developed for providing a hybrid auction including elements both of reverse and conventional auctioning. While some embodiments will be described herein with particular reference to that application, it will be appreciated that the invention is not limited to such a field of use, and is applicable in broader contexts.

BACKGROUND

Any discussion of the background art throughout the specification should in no way be considered as an admission that such art is widely known or forms part of common general knowledge in the field.

Internet-based auction facilities have become increasingly popular in recent years. From a technology perspective, it is widely recognized that success in the market requires a user interface that is both entertaining and equitable for buyers and sellers alike. However, in spite of the level of competition in the existing market, there remains a need for improved systems and methods for allocating units to users in an online environment.

SUMMARY OF THE INVENTION

The present invention may overcome or ameliorate one or more of the disadvantages of the prior art, or provide a useful alternative.

One embodiment provides a computer implemented method for allocating units to users, the method including:

maintaining access to data indicative of unit stockpiles, wherein each unit stockpile includes a plurality of units for allocation;

maintaining access to data indicative of stockpile allocation procedures, wherein each stockpile allocation procedure relates to a given one of the unit stockpiles, and wherein the data indicative of stockpile allocation procedures includes, for each stockpile allocation procedure:

data indicative of a current allocation price;

data indicative of none or more user offers, wherein each user offer specifies a submitting user, a unit offer price, and a desired quantity of units; and for each stockpile allocation procedure, conducting a method including:

(a) setting a commencement time;

(b) setting the current allocation price to a starting value;

(c) decrementing the current allocation price at predetermined intervals; and (d) in the case that a user offer has a unit offer price equal to or greater than the current allocation price, allocating to the specified submitting user a quantity of units equal to either the desired quantity or the remaining quantity in the stockpile.

One embodiment provides a computer system including a web server configured to deliver a web based interface to a plurality of user terminals, wherein the web server is configured to perform a method as described herein.

One embodiment provides a computer system including a microprocessor configured to perform a method as described herein.

One embodiment provides a tangible non-transient computer readable medium carrying executable code that when executed on one or more microprocessors of a computer system cause the computer system to perform a method as described herein.

One embodiment provides a computer program product configured for allowing the performance of a method as described herein.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

BRIEF DESCRIPTION OF THE DRAWINGS

Preferred embodiments of the invention will now be described, by way of example only, with reference to the accompanying drawings in which.

DETAILED DESCRIPTION

Figure 1:
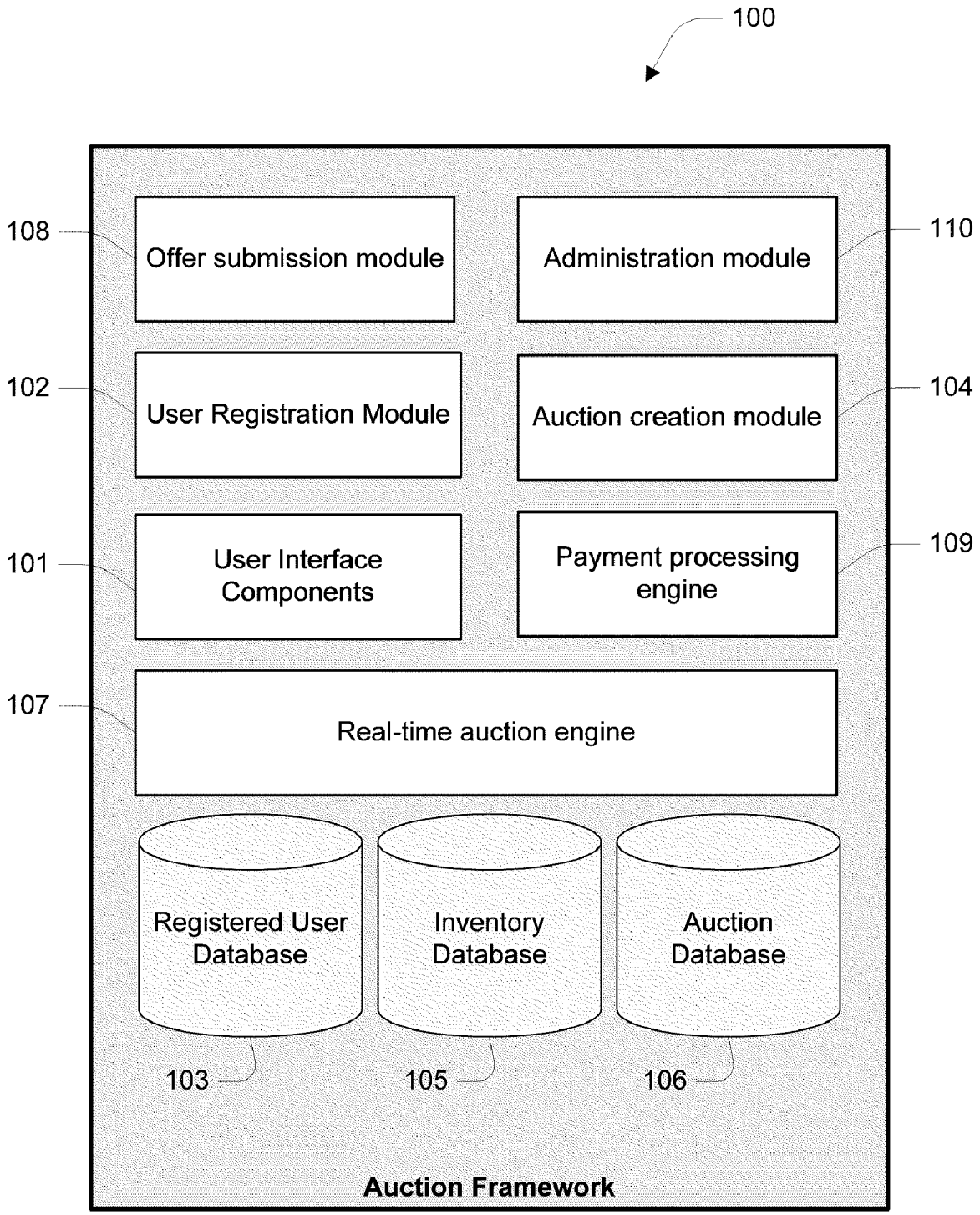
FIG. 1 schematically illustrates an exemplary auction framework according to one embodiment.

Described herein are systems and methods for allocating units to users, for example in the context of an online auction environment. In overview, the technology described herein provides for an auction process whereby a decrementing price is combined with a competitive hidden-bid process. Users participate in the auction for the purpose of obtaining a desired number of units from a stockpile of like units, such as bottles of a particular batch of wine. The users effectively have two modes of participation. The first is to purchase units at a system-defined price, which decrements at predetermined intervals. The second is to place a bid at a user-defined price, this bid being deemed as successful when the system-defined price decrements to a value of equal to or less than the user-defined price.

General Overview

One embodiment provides a computer implemented method for allocating units to users. For example, this method may be implemented based on software instructions executed on microprocessors of one or more computer systems. The method is presently described in the context of an online auction, however it will be appreciated that the present technology is by no means limited to that particular application.

The method includes maintaining access to data indicative of unit stockpiles (referred to as inventory data). Each unit stockpile includes a plurality of units for allocation, these being like units. In this regard, the present technology is particularly adapted for the auctioning of a stockpile of like items, as opposed to individual items. This is different from many existing online auctions, which manage units individually, and in the case that there is a desire to auction a plurality of like units, that occurs individually via a plurality of sequential or parallel auctions (or alternately via a single auction for the whole plurality of units). The present technology allows for a plurality of units to be auctioned for single or multiple acquisition via a single auction.

The method also includes maintaining access to data indicative of stockpile allocation procedures, which in essence is data relating to particular auctions (and hereon referred to as "auction data). Each stockpile allocation procedure (hereon referred to as an "auction") relates to a given one of the unit stockpiles. The data indicative of stockpile allocation procedures includes, for each auction:

Data indicative of a current allocation price.

Data indicative of none or more user offers, wherein each user offer specifies a submitting user, a unit offer price, and a desired quantity of units.

The relevance of this data will become clearer following explanation of the manner by which auctions are conducted.

As described herein, "maintaining access to data" is used to indicate that the data need not be maintained locally at a machine implementing a computer implemented method. This data may be maintained remotely, optionally ex-jurisdictionally.

The inventory data and auction data is used in the context of an auction method. In overview, each auction is conducted based on a method that commences upon a commencement trigger event. This trigger event may be defined, for instance, by a specified date/time or by the satisfaction of one or more criteria. For example, in one embodiment the trigger event is defined by the receipt of a certain number of preliminary user offers, or when a user offer is received having or exceeding a specific value. At the outset, the current allocation price is set to a starting value. This current allocation prices is then decremented at predetermined intervals. In the case that a user offer has a unit offer price equal to or greater than the current allocation price, allocating to the specified submitting user a quantity of units equal to either the desired quantity or the remaining quantity in the stockpile. More detailed explanation is provided in subsequent sections.

The term "unit" as used herein should be afforded a broad interpretation, including products, services, rights, securities and other intangibles, as well as collections thereof. For example, one embodiment provides wine auctions, whereby bottles of wines from a common source are auctioned as a unit stockpile. Another embodiment provides for allocation of shares to brokers and institutions, for example during an issue or book build. The present technology should in no way be limited to any specific form of units or unit stockpiles.

Furthermore, any reference to "like units" need not infer that units are necessarily identical; they need only be like in the sense that they are sufficiently similar as to be dealt with in the context of a unit stockpile for auctioning purposes. This is inherently subjective, and is in some cases managed by users who place the stockpiles for auction combined with user preparedness to participate in an auction for those units. For example, concert tickets are not necessarily identical, but nevertheless may be appropriate as units within a unit stockpile for the present purposes.

Exemplary Auction Framework

FIG. 1 schematically illustrates an exemplary auction framework 100. Although the present figure indicates that the various components are maintained in a common environment (such a as a single computer system), in various embodiments the components are distributed among a plurality of computer systems.

Framework 101 includes user interface components 101 for providing a interface by which users interact with the framework. For example, components 101 may include web-server components for providing a web-based interface with which users interact over the Internet using respective web browser applications. These user interface components also provide for data binding and data handling between what is displayed to users and what is defined elsewhere in the framework.

A user registration module 102 operates in conjunction with a registered user database 103 for allowing users to register to use framework 100. For example, users provide certain information, agree to terms and conditions, and are granted a login ID so that they can use functionalities of framework 100 and be uniquely identified when using those functionalities. In the present embodiment users include both vendors (being users that create auctions for their respective goods/services) and purchaser users (being users who compete in the auctions). These categorizations are of course not mutually exclusive.

An auction creation module 104 allows users to configure auctions for goods/services they wish to sell. In broad terms, user interface components provide users with access to module 104, such that users can upload details of unit stockpiles they wish to auction. This includes providing data indicative of the nature of units in stockpile, and the quantity of available units. This data is stored in an inventory database 105 Additional data may also be provided, depending on matters of design choice in particular embodiments, such as reserve prices and the like. This will be well understood by those familiar with online auction facilities. For example, in some embodiments users sets a starting price for his/her respective auction, a start time, and/or other auction parameters. This, along with other auction data, is maintained in an auction record for the relevant auction in an auction database 106. This auction record also provides a destination for offer data stemming from user bids placed prior to and/or during the auction process.

A real-time auction engine 107 is responsible for performing the general auction method, which requires access to both database 105 (for instance to ascertain the quantity of units available for allocation) and database 106 (which maintains data indicative of a current allocation price and data indicative of user offers). Methods implemented by this auction engine are considered in more detail elsewhere in the present document.

An offer submission module 108 allows users to submit user offers in respect of auctions defined in database 106. In the present embodiment, offers can be submitted prior to and during the real-time auction process. That is, users are able to place offers indicative of a unit price and quantity of units even before the auction commences (with commencement being defined by the setting of a starting value and periodic decrementing of that value).

Based on output of auction engine 107, a payment processing engine 109 is responsible for coordinating financial aspects of transactions resulting from the allocation of units to users via the auction process. Numerous payment engines are known in the E-commerce space, optionally including third-party facilities such as PayPal. Which of these is/are used is a matter of design choice.

Finally, an administrator module 110 allows administrators to perform various functions related to the configuration, monitoring, and operation of the framework as a whole.

Exemplary Auction Method

Figure 2:
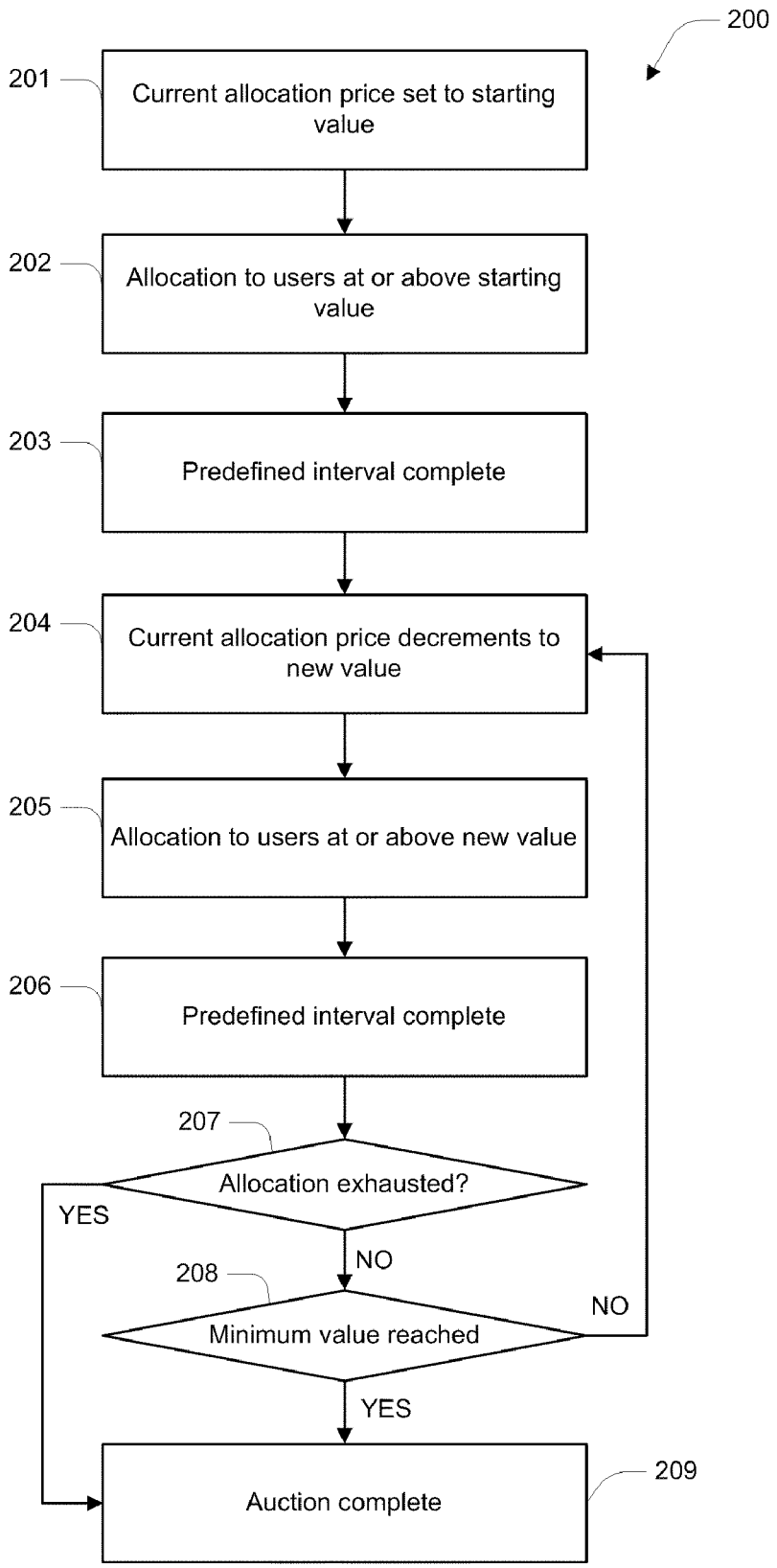
FIG. 2 illustrates a method according to one embodiment.

FIG. 2 illustrates an exemplary auction process, in the form of method 200. This method is presently described by reference to the operation of real-time auction engine 107. That is, the method is conducted based on the execution of software instructions (i.e. machine readable code) that embody engine 107. Information regarding this method is made available in real time to users via user interface components 101, for example such that users are able to view the information via a website and interactively participate in the auction.

The auction process commences at step 201, at which point the current allocation price (referred to as $P_{CURRENT}$, being a unit price as opposed to a price for a plurality of units) is set to a starting value (referred to as $P_{START}$). That is, at step 201, $P_{CURRENT}=P_{START}$. At step 202, units are allocated to users associated with user offers having offer price (referred to $P_{OFFER}$, also being a unit price as opposed to a price for a plurality of units) greater than or equal to $P_{START}$. This may include user offers place prior to the commencement of the live auction (i.e. prior to step 201), or offers placed following commencement of the live auction (i.e. following step 201). In this regard, there are two primary approaches by which users submit user offers:

Direct purchase offers. During the live auction procedure, a user is able to place an offer equal to the current allocation price (i.e. $P_{OFFER}=P_{CURRENT}$), thereby to obtain a desired quantity of units at that price. This is a relatively predictable mode of participation, as a user is in essence able to purchase a desired quantity of units at a system-defined price in real time.

Speculative offers. During or prior to the live auction procedure, a user is able to place an offer of any price (or in some cases any price above a predefined minimum value). This offer, as with other offers considered herein, includes both a unit price and a desired number of units. A user who participates in this way is not guaranteed to be allocated the desired number of units (or for that matter any units) if the available allocation is exhausted prior to $P_{CURRENT}$ falling to or below his/her respective $P_{OFFER}$. However, there are advantages in the sense that the user need not interact with the auction in real time.

A predefined interval completes at step 203, at which time $P_{CURRENT}$ decrements to a lesser value at step 204. That is, following step 204, a user is able to make a direct purchase offer at a lower $P_{OFFER}$ as compared with prior to step 204. At step 205, units are allocated to users associated with user offers having $P_{OFFER}$ greater than or equal to the new $P_{CURRENT}$. The predefined interval completes again at 206, at which time two factors are considered:

Whether there are any units remaining for allocation (decision 207). If no units remain, the method terminates at step 209. Otherwise, the method continues to decision 208.

Whether $P_{CURRENT}$ has reached a defined minimum value (decision 208). If the minimum value is reached, the method terminates at step 209. Otherwise, the method loops to step 204, at which point $P_{CURRENT}$. decrements once again.

The length of the predefined interval varies between embodiments and implementations, and in some case is user defined by way of the auction creation process. For example, intervals in the order of seconds, minutes, hours, days weeks, or longer may be appropriate in particular circumstances. Furthermore, the interval need not be consistent (i.e. the length of interval may increase or decrease from one interval to the next based on a predefined algorithm). Likewise, the quantum of decrement varies between embodiments and implementations, and is optionally defined in terms of percentage or in terms of a value. By way of example, in one exemplary auction $P_{START}$ is set at $500, and $P_{CURRENT}$ decrements on an hourly basis by $10 each interval. This continues until either $P_{CURRENT}$ reaches a defined minimum value (for example $10) or until the allocation of units is exhausted.

As a general rule, upon decrementing $P_{CURRENT}$, offers having $P_{OFFER}$ greater than or equal to the new $P_{CURRENT}$ based on speculative offers are prioritized and allocations made from highest $P_{OFFER}$ to lowest $P_{OFFER}$ (with the lowest being equal to $P_{CURRENT}$) prior to direct purchase offers being accepted at the new $P_{CURRENT}$.

In many cases, the allocation of units may be exhausted during one of the intervals. It will be appreciated that in such cases no further offers are accepted. Furthermore, in some instances this may occur prior to any direct purchase offers being accepted at a given $P_{CURRENT}$, where the remaining allocation is exhausted by speculative offers addressed during that interval.

In the present embodiment, if the desired quantity of units associated with a user offer exceeds the available quantity of units, the relevant user is allocated the remaining available quantity of goods as an alternative, but still at the $P_{OFFER}$ associated with that offer (noting that $P_{OFFER}$ defined a unit price).

Buyers who make use of direct purchase offers are able to hold out on placing offers whilst $P_{CURRENT}$ decrements, thereby having an opportunity to secure a particularly low price. However, there is a risk that all units could be allocated prior to a user making a direct purchase offer, causing the user to miss out completely.

Although method 200 indicates that at least two intervals are completed, it will be appreciated that in some cases all units may be allocated at $P_{START}$, in which case the method terminates prior to step 204.

In various embodiments graphical user interface items are displayed to users to provide additional feedback into the live auction process. This may include the likes of clock devices for timing the predefined interval, stock indicators for providing an indication as to the available quantity of units remaining, and value indicators which represent a relationship between $P_{START}$ and $P_{CURRENT}$ (with a greater difference inferring better value).

Upon completion of the auction at step 209, and optionally during the auction process, the auction engine outputs data indicative of the allocation of units to users. This is used to inform users of what they have won via the auction, to inform a vendor in relation to the users to which units have been allocated, and to allow transactions for the payment of units to be coordinated.

Administration of Speculative Offers

As noted, user offers are made as either direct purchase offers or speculative offers. Described below are some exemplary protocols applied to the administration of speculative offers according to the present embodiment.

As a starting point, speculative offers are binding. That is, once placed they cannot be withdrawn or modified to reduce $P_{OFFER}$. In the present embodiment, however, they can be modified to increase $P_{OFFER}$. It will be appreciated that this adds additional integrity to the overall process.

Speculative offers are submitted by default hidden from other users. That is, they are not published, thereby preventing users from actively taking steps to outbid one another as is usual in traditional auctions. This encourages users to place bids at a price they are willing to pay as a default, given the lack of context regarding the activity of other users.

In some cases an exception is applied, and some speculative offers published in part. This occurs where the total quantity of desired units from received speculative offers received in respect of a given unit stockpile exceeds the quantity of available units. That is, there are not enough units to cover all speculative offers. In this case, the $P_{OFFER}$ of the lowest speculative offer that could be met (partially or wholly) by the available allocation is published thereby to prevent users from inadvertently submitting completely redundant speculative offers. This $P_{OFFER}$ is subsequently treated as a minimum $P_{OFFER}$ for that auction.

Speculative offers are ranked as submitted. The ranking is initially in terms of $P_{OFFER}$, (greater $P_{OFFER}$ values are ranked higher) and subsequently in terms of time (earlier submitted offers are ranked higher). This assists in prioritizing allocation of units to users, which becomes particularly important when allocation nears exhaustion. In the present embodiment, whenever the quantity of units required to fulfill all speculative offers, then lower speculative offers are automatically purged from the system.

In some embodiments, the user responsible for creating a given auction (referred to as the vendor) is permitted to place a special category of speculative offer, referred to as a "vendor reserve offer". These are in essence treated in the same manner as usual speculative offers, except they only come into consideration at the commencement of the live auction. Vendor reserve offers that are out-ranked by standard speculative offers are purged from the system. Additionally, standard speculative offers that are out-ranked by vendor reserve offers are purged from the system. Units are withdrawn from the auction when a vendor reserve offer is equal or greater than $P_{CURRENT}$.

Floating Starting Prices

In some embodiments, $P_{OFFER}$ for a given auction is defined by the vendor responsible for creating that auction. However, other embodiments make use of a floating starting price. In some cases this is an available option for all auctions. This may, for example, be of use in instances where the value of the goods cannot be accurately determined and the vendor would prefer that the market demand play a role.

In overview, where a floating starting price is to be used, the system does not display $P_{START}$ prior to the commencement of a live auction. Users are permitted to place speculative offers prior to commencement of the live auction, and $P_{START}$ is subsequently defined based on those offers (for example as a value equal to the highest offer or greater than the highest offer by a specified margin, optionally defined in terms of percentage or quantum).

Prioritization for Non-Identical Units

Although the present technology is particularly adapted for the auctioning of a stockpile of like items, in some cases not all items are identical. That is, some units may have a higher value (being a higher real or perceived value). An example is tickets to a concert or sporting event; there will always be some seating locations that are superior to others. In some embodiments the present technology is adapted to apply prioritized allocation in such circumstances. One approach includes ordering units in a unit stockpile in terms of a value rating, and allocating these to successful users in an order determined by prioritization rules. These prioritization rules are in some cases defined to allocate higher value units to users that paid a higher price (i.e. highest price payer receives highest value unit, lowest price payer receives lowest price unit), and in other cases to allocate higher value units to users that placed earlier speculative offers (i.e. earliest speculative offer receives highest value unit). In some cases a combination of these approaches is used.

Exemplary System-Level Overview

Figure 3:
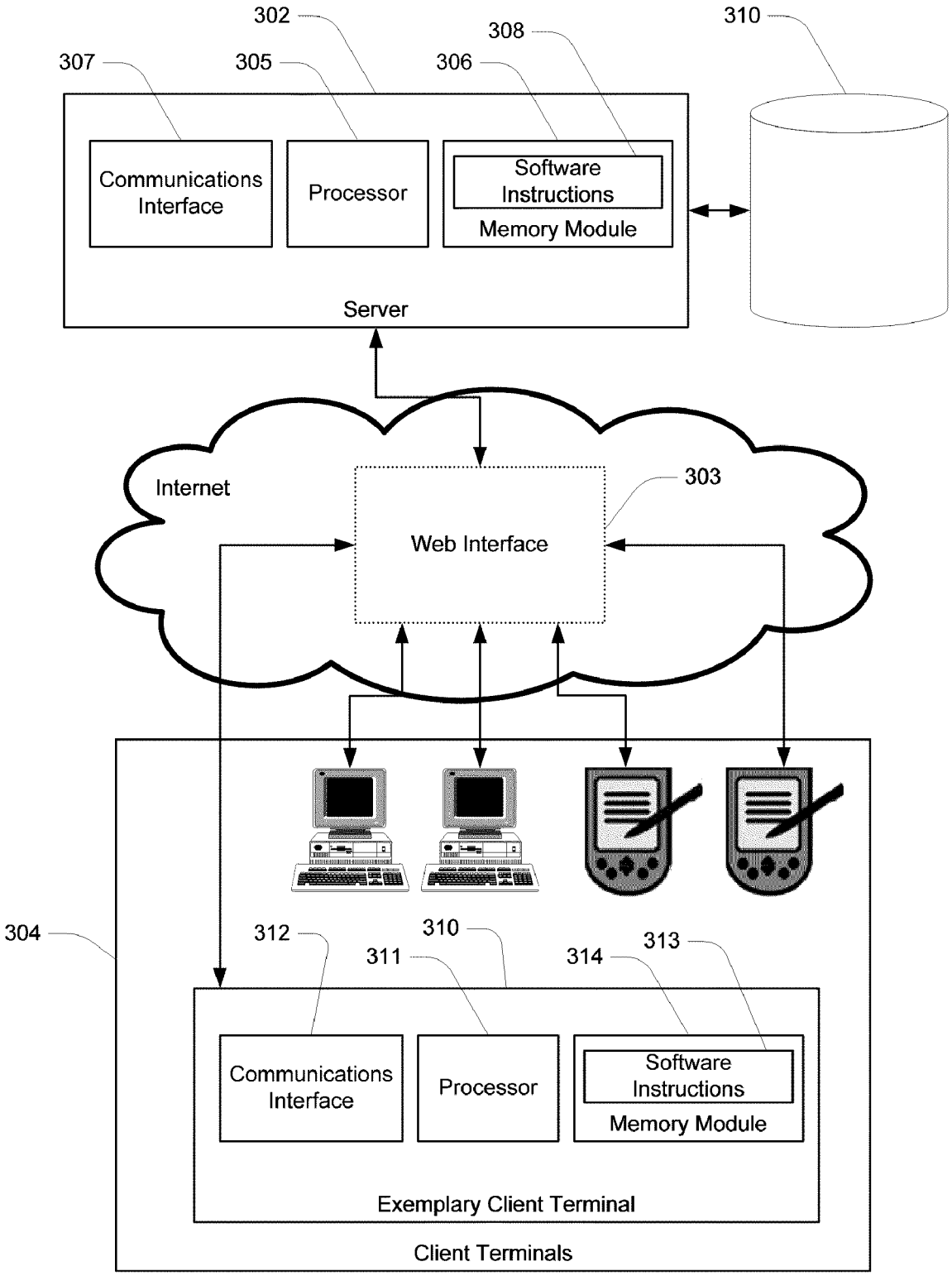
FIG. 3 illustrates a computer implementation arrangement according to one embodiment.

In some embodiments, methods considered herein are implemented by way of a server, as illustrated in FIG. 3. In overview, a web server 302 provides a web interface 303. This web interface is accessed by the parties by way of client terminals 304. In overview, users access interface 303 over the Internet by way of client terminals 304, which in various embodiments include the likes of personal computers, PDAs, cellular telephones, gaming consoles, and other Internet enabled devices.

Server 303 includes a processor 305 coupled to a memory module 306 and a communications interface 307, such as an Internet connection, modem, Ethernet port, wireless network card, serial port, or the like. In other embodiments distributed resources are used. For example, in one embodiment server 302 includes a plurality of distributed servers having respective storage, processing and communications resources. Memory module 306 includes software instructions 308, which are executable on processor 305.

Server 302 is coupled to a database 310, which in some embodiments includes a plurality of distributed storage locations. In further embodiments the database leverages memory module 306.

In some embodiments web interface 303 includes a website. The term "website" should be read broadly to cover substantially any source of information accessible over the Internet or another communications network (such as WAN, LAN or WLAN) via a browser application running on a client terminal. In some embodiments, a website is a source of information made available by a server and accessible over the Internet by a web-browser application running on a client terminal. The web-browser application downloads code, such as HTML code, from the server. This code is executable through the web-browser on the client terminal for providing a graphical and often interactive representation of the website on the client terminal. By way of the web-browser application, a user of the client terminal is able to navigate between and throughout various web pages provided by the website, and access various functionalities that are provided.

Although some embodiments make use of a website/browser-based implementation, in other embodiments proprietary software methods are implemented as an alternative. For example, in such embodiments client terminals 304 maintain software instructions for a computer program product that essentially provides access to a portal via which auction data (for example offers and the like) is able to be submitted over a network (typically the Internet) to a central location (i.e. server 302).

In general terms, each terminal 304 includes a processor 311 coupled to a memory module 313 and a communications interface 312, such as an internet connection, modem, Ethernet port, serial port, or the like. Memory module 313 includes software instructions 314, which are executable on processor 311. These software instructions allow terminal 304 to execute a software application, such as a proprietary application or web browser application and thereby render on-screen a user interface and allow communication with server 302. This user interface allows for the creation, viewing and administration of profiles, access to the internal communications interface, and various other functionalities.

Unless specifically stated otherwise, as apparent from the following discussions, it is appreciated that throughout the specification discussions utilizing terms such as "processing," "computing," "calculating," "determining", analyzing" or the like, refer to the action and/or processes of a computer or computing system, or similar electronic computing device, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. The processing system further may be a distributed processing system with processors coupled by a network. If the processing system requires a display, such a display may be included, e.g., a liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term memory unit as used herein, if clear from the context and unless explicitly stated otherwise, also encompasses a storage system such as a disk drive unit. The processing system in some configurations may include a sound output device, and a network interface device. The memory subsystem thus includes a computer-readable carrier medium that carries computer-readable code (e.g., software) including a set of instructions to cause performing, when executed by one or more processors, one of more of the methods described herein. Note that when the method includes several elements, e.g., several steps, no ordering of such elements is implied, unless specifically stated. The software may reside in the hard disk, or may also reside, completely or at least partially, within the RAM and/or within the processor during execution thereof by the computer system. Thus, the memory and the processor also constitute computer-readable carrier medium carrying computer-readable code.

Furthermore, a computer-readable carrier medium may form, or be included in a computer program product.

In alternative embodiments, the one or more processors operate as a standalone device or may be connected, e.g., networked to other processor(s), in a networked deployment, the one or more processors may operate in the capacity of a server or a user machine in server-user network environment, or as a peer machine in a peer-to-peer or distributed network environment. The one or more processors may form a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Note that while some diagrams only show a single processor and a single memory that carries the computer-readable code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, one embodiment of each of the methods described herein is in the form of a computer-readable carrier medium carrying a set of instructions, e.g., a computer program that is for execution on one or more processors, e.g., one or more processors that are part of web server arrangement. Thus, as will be appreciated by those skilled in the art, embodiments of the present invention may be embodied as a method, an apparatus such as a special purpose apparatus, an apparatus such as a data processing system, or a computer-readable carrier medium, e.g., a computer program product. The computer-readable carrier medium carries computer readable code including a set of instructions that when executed on one or more processors cause the processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code embodied in the medium.

The software may further be transmitted or received over a network via a network interface device. While the carrier medium is shown in an exemplary embodiment to be a single medium, the term "carrier medium" should be taken to include a single medium or multiple media (e.g., a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media. Non-volatile media includes, for example, optical, magnetic disks, and magneto-optical disks. Volatile media includes dynamic memory, such as main memory. Transmission media includes coaxial cables, copper wire and fiber optics, including the wires that comprise a bus subsystem. Transmission media also may also take the form of acoustic or light waves, such as those generated during radio wave and infrared data communications. For example, the term "carrier medium"

shall accordingly be taken to included, but not be limited to, solid-state memories, a computer product embodied in optical and magnetic media; a medium bearing a propagated signal detectable by at least one processor of one or more processors and representing a set of instructions that, when executed, implement a method; and a transmission medium in a network bearing a propagated signal detectable by at least one processor of the one or more processors and representing the set of instructions.

It will be understood that the steps of methods discussed are performed in one embodiment by an appropriate processor (or processors) of a processing (i.e., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

Conclusions

It will be appreciated that the disclosure above provides various novel and inventive systems and methods for allocating units to users. In particular, the use of hybrid auction framework including a decrementing direct purchase price and a competitive hidden bid process provides a particularly advantageous approach to online auctioning.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The claims defining the invention are as follows:

1. A computer implemented method for allocating units to users, the method comprising:

maintaining access by at least one processor based system to data indicative of unit stockpiles, wherein each unit stockpile includes a plurality of units for allocation;

maintaining access by at least one processor based system to data indicative of stockpile allocation procedures, wherein each stockpile allocation procedure relates to a given one of the unit stockpiles, and wherein the data indicative of stockpile allocation procedures includes, for each stockpile allocation procedure:

data indicative of a current allocation price $P_{CURRENT}$ data indicative of one or more user offers, including direct purchase offers and speculative user offers, wherein each user offer specifies a submitting user, a unit offer price $P_{OFFER}$, and a desired quantity of units; and for each stockpile allocation procedure, executing a program stored in a microprocessor, the program comprising instructions to:

(a) receive one or more speculative user offers, wherein each speculative user offer is associated with a respective submitting user, each speculative user offer having a unit offer price $P_{OFFER}$ selected by the respective submitting use without being bound to $=P_{CURRENT}$, such that $P_{OFFER}=P_{CURRENT}$ or $P_{OFFER}\neq P_{CURRENT}$;

(b) following (a), at a commencement time, setting the current allocation price $P_{CURRENT}$ to a starting value $P_{START}$;

(c) at the commencement time, identify each speculative offer for which $P_{OFFER}\geqq P_{START}$ and, for each identified speculative offer, allocating to the specified submitting user a quantity of units equal to the desired quantity;

(d) following (c), provide an interface configured to receive one or more direct purchase offers having a unit offer price of $P_{OFFER}=P_{CURRENT}=P_{START}$;

(e) following (d), allocate units based on received direct purchase offers of $P_{OFFER}=P_{CURRENT}=P_{START}$;

(f) following (e), decrement the current allocation price $P_{CURRENT}$ from $P_{CURRENT}=P_{START}$ to a new $P_{CURRENT}$;

(g) following (f), identify each speculative offer for which $P_{OFFER}\leqq P_{CURRENT}\leqq P_{START}$ and, for each identified offer, allocating to the specified submitting user a quantity of units equal to the desired quantity;

(h) following (g), provide an interface configured to receive one or more direct purchase offers having a unit offer price of $P_{OFFER}=P_{CURRENT}$;

(i) following (h), allocate units based on direct purchase offers of $P_{OFFER}=P_{CURRENT}$, and (j)following (i), looping to step (f) and continue until, for a given identified offer, the desired quantity of units is greater than a remaining number of units for allocation.

2. A method according to claim 1 further comprising: at any time following (a), receiving one or more further speculative user offers, wherein each speculative user offer is associated with a respective submitting user, each speculative user offer having a unit offer price $P_{OFFER}<P_{CURRENT}$.

3. A method according to claim 1 wherein the starting value is determined responsive to one or more speculative offers submitted prior to or after the commencement time.

4. A method according to claim 1 wherein data indicative of a user offer received from a given user is hidden from other users.

5. A method according to claim 1 wherein the user offers are ranked primarily based on unit offer price and secondarily on time of receipt.

6. A method according to claim 1, further comprising: receiving from a user by at least one processor based system data indicative of a unit stockpile and parameters for a stockpile allocation procedure in respect of that unit stockpile, thereby allowing user creation of that stockpile allocation procedure.

7. The method according to claim 1 wherein conducting a method by at least one processor based system includes conducting the method by a server computer.

8. A computer system, comprising:

a microprocessor configured to:

maintain access to data indicative of unit stockpiles, wherein each unit stockpile includes a plurality of units for allocation;

maintain access to data indicative of stockpile allocation procedures, wherein each stockpile allocation procedure relates to a given one of the unit stockpiles, and wherein the data indicative of stockpile allocation procedures includes, for each stockpile allocation procedure:

data indicative of a current allocation price $P_{CURRENT}$ data indicative of one or more user offers, including direct purchase offers and speculative user offers, wherein each user offer specifies a submitting user, a unit offer price $P_{OFFER}$, and a desired quantity of units; and for each stockpile allocation procedure:

(a) receive one or more speculative user offers, wherein each speculative user offer is associated with a respective submitting user, each speculative user offer having a unit offer price $P_{OFFER}$ selected by the respective submitting use without being bound to $=P_{CURRENT}$, such that $P_{OFFER}=P_{CURRENT}$ or $P_{OFFER}\neq P_{CURRENT}$;

(b) following (a), at a commencement time, setting the current allocation price $P_{CURRENT}$ to a starting value $P_{START}$;

(c) at the commencement time, identify each speculative offer for which $P_{OFFER}\geqq P_{START}$ and, for each identified speculative offer, allocating to the specified submitting user a quantity of units equal to the desired quantity;

(d) following (c), provide an interface configured to receive one or more direct purchase offers having a unit offer price of $P_{OFFER}=P_{CURRENT}=P_{START}$;

(e) following (d), allocate units based on received direct purchase offers of $P_{OFFER}=P_{CURRENT}=P_{START}$;

(f) following (e), decrement the current allocation price $P_{CURRENT}$ from $P_{CURRENT}=P_{START}$ to a new $P_{CURRENT}$;

(g) following (f), identify each speculative offer for which $P_{OFFER}\leqq P_{CURRENT}\leqq P_{START}$ and, for each identified offer, allocating to the specified submitting user a quantity of units equal to the desired quantity;

(h) following (g), provide an interface configured to receive one or more direct purchase offers having a unit offer price of $P_{OFFER}=P_{CURRENT}$;

(i) following (h), allocate units based on direct purchase offers of $P_{OFFER}=P_{CURRENT}$, and (j)following (i), looping to step (f) and continue until, for a given identified offer, the desired quantity of units is greater than a remaining number of units for allocation.

9. The computer system according to claim 8 wherein the computer system is a web server configured to deliver a web based interface to a plurality of user terminals.

10. A tangible non-transient computer-readable medium carrying executable code that when executed on one or more microprocessors of a computer system cause the computer system to:

maintain access to data indicative of unit stockpiles, wherein each unit stockpile includes a plurality of units for allocation;

maintain access to data indicative of stockpile allocation procedures, wherein each stockpile allocation procedure relates to a given one of the unit stockpiles, and wherein the data indicative of stockpile allocation procedures includes, for each stockpile allocation procedure:

data indicative of a current allocation price $P_{CURRENT}$ data indicative of one or more user offers, including direct purchase offers and speculative user offers, wherein each user offer specifies a submitting user, a unit offer price $P_{OFFER}$, and a desired quantity of units; and for each stockpile allocation procedure:

(a) receive one or more speculative user offers, wherein each speculative user offer is associated with a respective submitting user, each speculative user offer having a unit offer price $P_{OFFER}$ selected by the respective submitting use without being bound to $=P_{CURRENT}$, such that $P_{OFFER}=P_{CURRENT}$ or $P_{OFFER}\neq P_{CURRENT}$;

(b) following (a), at a commencement time, setting the current allocation price $P_{CURRENT}$ to a starting value $P_{START}$;

(c) at the commencement time, identify each speculative offer for which $P_{OFFER}\leqq P_{START}$ and, for each identified speculative offer, allocating to the specified submitting user a quantity of units equal to the desired quantity;

(d) following (c), provide an interface configured to receive one or more direct purchase offers having a unit offer price of $P_{OFFER}=P_{CURRENT}=P_{START}$;

(e) following (d), allocate units based on received direct purchase offers of $P_{OFFER}=P_{CURRENT}=P_{START}$;

(f) following (e), decrement the current allocation price $P_{CURRENT}$ from $P_{CURRENT}=P_{START}$ to a new $P_{CURRENT}$;

(g) following (f), identify each speculative offer for which $P_{OFFER} \leqq P_{CURRENT} \leqq P_{START}$ and, for each identified offer, allocating to the specified submitting user a quantity of units equal to the desired quantity;

(h) following (g), provide an interface configured to receive one or more direct purchase offers having a unit offer price of $P_{OFFER}=P_{CURRENT}$;

(i) following (h), allocate units based on direct purchase offers of $P_{OFFER}=P_{CURRENT}$, and (j) following (i), looping to step (f) and continue until, for a given identified offer, the desired quantity of units is greater than a remaining number of units for allocation.

11. The tangible non-transient computer readable medium carrying executable code according to claim 10, wherein the computer system is a server computer system, and wherein when executed on one or more microprocessors of the server computer system the executable code cause the server computer system to perform the acts (a) through (j).

* * * * *